United States Patent [19]

Streich

[11] 4,069,531

[45] Jan. 24, 1978

[54] ORTHOPEDIC SHOE TREE

[76] Inventor: René Streich, Bettenstrasse, 64, Allschwil, Switzerland, CH-4123

[21] Appl. No.: 746,209

[22] Filed: Dec. 1, 1976

[30] Foreign Application Priority Data

Dec. 1, 1975 Switzerland ..... 15695/75

[51] Int. Cl.[2] ..... A43D 5/00

[52] U.S. Cl. ..... 12/116.2

[58] Field of Search ..... 12/116.8, 117.2, 115.8, 12/116.2, 116.4, 116.6

[56] References Cited

U.S. PATENT DOCUMENTS

| | | | |
|---|---|---|---|
| 2,376,926 | 5/1945 | Loewer | 12/116.2 |
| 2,424,669 | 7/1947 | Rinnela | 12/116.2 |
| 2,513,664 | 7/1950 | Mutch | 12/115.8 |
| 3,239,860 | 3/1966 | Iredale | 12/115.8 |

*Primary Examiner*—Patrick D. Lawson

*Attorney, Agent, or Firm*—Thomas W. Speckman

[57] ABSTRACT

An orthopedic shoe tree for the shoes of persons with foot or toe deformity having a front stretching part and a rear heel part. The front stretching part has two separate front foot form halves between which a stretching wedge fits whereby the halves may be forced apart by movement of the stretching wedge. The rear heel part and front stretching part are connected by loose articulation.

8 Claims, 7 Drawing Figures

ORTHOPEDIC SHOE TREE

The invention concerns an orthopedic shoe tree, particularly for shoes of patients with slight foot or toe deformations.

Shoe trees for various purposes are known. The most common shoe trees serve only for the maintenance of the shoe shape, especially of the upper. A further group is represented by those shoe trees which serve to stretch the shoe. With stretching a slight size adjustment can be achieved or it can serve for shape-moulding purposes.

Orthopedic shoe trees are often complicated and large devices which, because of their initial cost are only used in shoe shops. Such apparatus must be easily adjusted or modified so that they can meet various requirements.

An object of this invention is to provide an orthopedic shoe tree which can be adjusted with simple means according to a patient's foot, but be dimensioned only for a specific patient's foot.

The solution is found with a shoe tree which is characterized by two completely separate front foot form halves each of which has in its separation surface a longitudinal groove which opens into a wedge-shaped channel and is linked loosely with the stretching wedge by means of a tightening screw running along the separation surface.

Particularly advantageous is a shoe tree in which the tightening screw has a central depression in its head in which a pointed setscrew of the heel part rests.

In the drawings one embodiment of the shoe tree of the invention is shown wherein.

Figure 1:
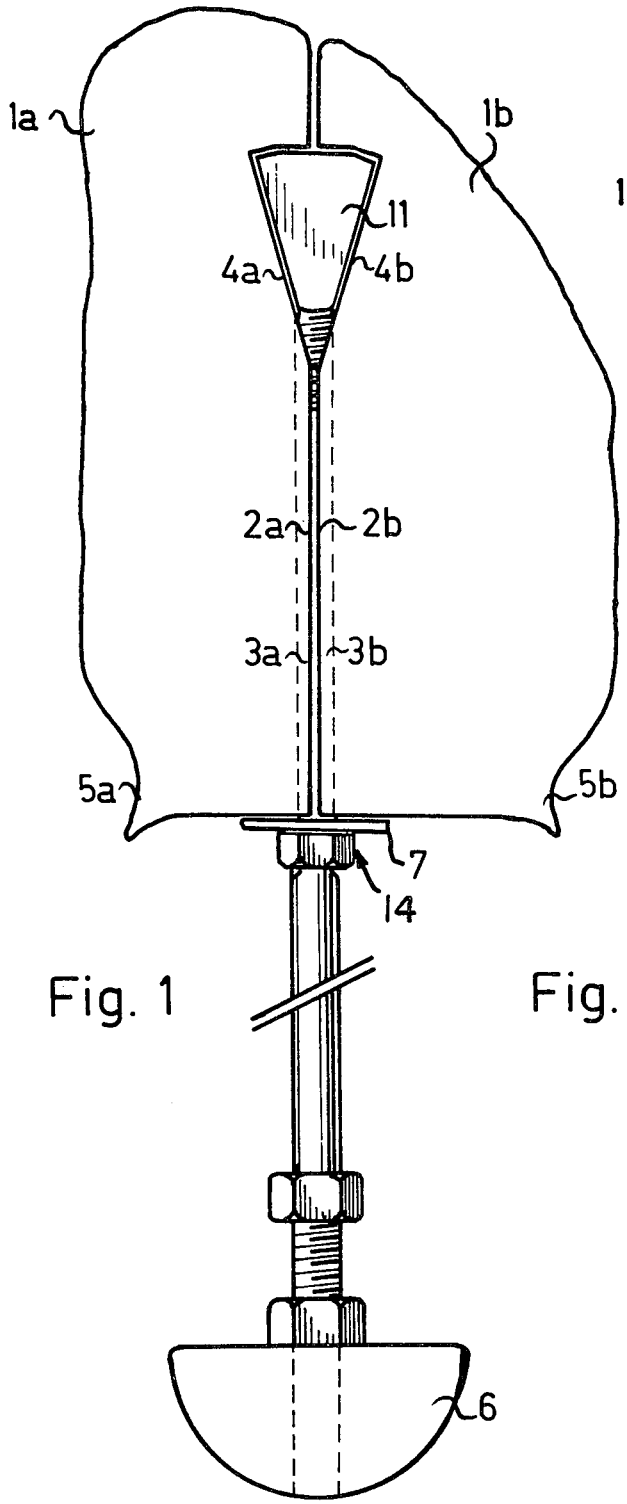
FIG. 1 shows a top view of a shoe tree of this invention.

In FIG. 1 can be seen an overall view of the shoe tree. The two foot form halves are indicated by 1*a* and 1*b*. They are in contact with each other on their separating surfaces 2*a* and 2*b*. Both parts are completely separate, however, and are kept in their desired positions by the shoe. Both halves consist of wood or plastic and are made individually precisely according to the form of the patient's foot.

In the separation surfaces 2*a* and 2*b* there are, for example, semi-circular longitudinal grooves 3*a* and 3*b* which open into wedge channels 4*a* and 4*b*. A further characteristic in regard to the forms is that each foot form half has a shoulder 5*a* and 5*b*.

Figure 2:
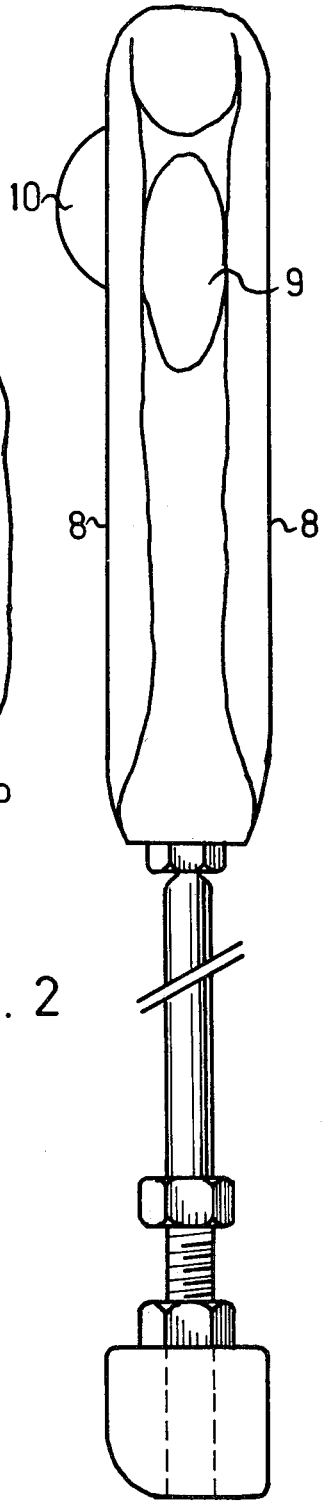
FIG. 2 shows a side view of the shoe tree of FIG. 1.

In the side view of FIG. 2 it can be seen that the foot form halves are flat, which means that they can be used for both a left and a right shoe. In fitting for the patient, therefore, one can start with relatively simple, uniform blanks. The lateral surfaces 9 can be quickly prepared by removal of material or nailing on form parts. Even upward shaping can easily be achieved by means of superimposition of form part 10.

The third, non-metallic part is the heel piece 6. It has no shape-forming function. Rather, the heel part serves to insure the correct positioning of the foot form halves.

If so desired, the shoe tree can also serve for stretching the shoe structure.

The metallic parts of the shoe tree are shown in the detail drawings FIGS. 3–7.

The whole shoe tree consists of several loose parts, which on the one hand constitute a stretching part, on the other a pressure part. The stretching part includes the two foot form halves 1*a* and 1*b* ith the stretching wedge 11 and the tightening screw 14. The pressure part consists of the described heel part 6, as well as a setscrew 20. The pressure part and stretching part are only loosely connected with each other.

Figure 3:
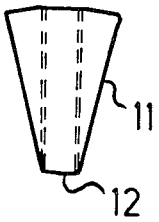
FIG. 3 shows the shoe tree stretching wedge.
Figure 4:
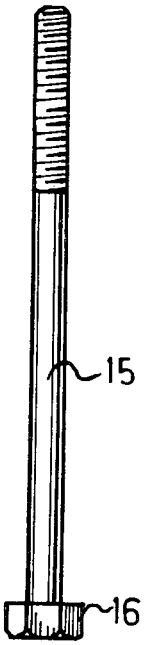
FIG. 4 shows the shoe tree tightening screw.
Figure 5:
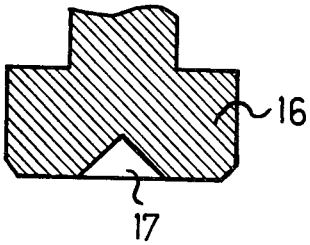
FIG. 5 shows sectional detail of the shoe tree tightening screw.

FIG. 3 shows the stretching wedge 11 with a hole having internal thread 12. The screw 15, shown in FIG. 4, reveals no special peculiarity at first glance. Its relatively long shaft is provided with a thread for only about half its length. Not visible in FIG. 4, and therefore shown in sectioned FIG. 5, is the design of the hexagonal screw head 16. In the section of the screw head 16 can be seen a center depression 17, which has an angle of something more than 90°.

Figure 6:
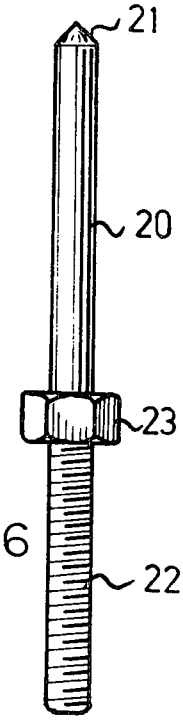
FIG. 6 shows the shoe tree setscrew.

The pressure part comprises the setscrew 20, which is actually a rod which has on one end point 21 and at the other, a thread 22 shown in FIG. 6. At the end of the thread, about in the middle of the rod, there is a fixed nut 23. In normal position the point 21 is in the center depression 17.

Figure 7:
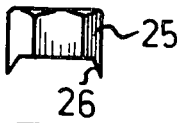
FIG. 7 shows the shoe tree nut for holding the heel part.

FIG. 7 shows a nut 25 for holding the heel part 6. As compared to an ordinary nut, this one is differentiated by angular projections 26 which extend into the heel part 6 permitting longitudinal adjustment by rotation of thread 22 in nut 25. Not represented in the detail drawings of FIGS. 3–7 is washer 7, which is, however, clearly visible in FIG. 1.

When a patient's shoe is to be shaped, the whole shoe is preferably placed in water or a water-alcohol mixture. Then the stretching part of the shoe tree is pushed into the shoe and the screw 15 tightened. The wedge 11 now forces the two foot form halves apart. In order to hold the stretching part in the right position, the pressure part consisting of heel part 6 and setscrew 20 is inserted into the shoe. The point 21 of the screw 20 goes into the depression 17 in the screw head 16 of the tightening screw 15. The division of the shoe tree and the loose articulation makes it possible to use the shoe tree even in ladies'shoes with high heels. The angle of the depression 17 is necessarily greater than the angle of the point 21.

The shoulders 5*a* and 5*b* are of secondary importance. They are to hold a rubber band that keeps the foot form halves when not in use, from sliding off the stretching wedge and screw 15.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An orthopedic shoe tree for the shoe of persons with a slight foot or toe deformity comprising; two completely separate front foot form halves each of which has in its facing separation face a longitudinal groove opening into a wedge channel, a stretching wedge within said wedge channel in communication with a tightening screw within said longitudinal grooves and having a head portion to the rearward of said form halves, and a longitudinally moveable heel part having an adjustable setscrew which is loosely linked with the head of said tightening screw.

2. A shoe tree according to claim 1, characterized by the tightening wedge having a longitudinal hole with internal threads.

3. A shoe tree according to claim 1, characterized by the tightening screw having a central depression in the head, in which the pointed setscrew of the heel part rests.

4. A shoe tree according to claim 1, characterized by the fact that a fixed nut is located on the setscrew.

5. A shoe tree according to claim 1, characterized by the fact that on the setscrew there is located a nut with angular projections which is in solid contact with the heel part.

6. A shoe tree according to claim 1, characterized by the front foot form halves are wood.

7. A shoe tree according to claim 1, characterized by at least the front foot form halves being plastic.

8. A shoe tree according to claim 1, characterized by the foot form halves each having a shoulder for holding an elastic holding means to retain the form halves in position on the wedge and tightening screw when not within a shoe.

* * * * *